US006849130B2

(12) United States Patent
Estelle

(10) Patent No.: US 6,849,130 B2
(45) Date of Patent: Feb. 1, 2005

(54) FLUID DISPENSER WITH AUTOMATIC COMPENSATION AND METHOD

(75) Inventor: Peter W. Estelle, Norcross, GA (US)

(73) Assignee: Nordson Corporation, Westlake, OH (US)

( * ) Notice: Subject to any disclaimer, the term of this patent is extended or adjusted under 35 U.S.C. 154(b) by 511 days.

(21) Appl. No.: 09/999,058

(22) Filed: Oct. 31, 2001

(65) Prior Publication Data

US 2003/0080159 A1 May 1, 2003

(51) Int. Cl.[7] ..... B05C 11/10

(52) U.S. Cl. ..... 118/682; 118/702; 118/703; 118/708; 118/712; 156/356; 156/357; 156/366

(58) Field of Search ..... 18/703, 702, 699, 18/682, 681, 679, 683, 684, 708, 712, 713, 696; 156/356, 357, 366; 222/639, 644; 239/70

(56) References Cited

U.S. PATENT DOCUMENTS 4,957,782 A * 9/1990 Medler et al. ..... 427/421
5,683,752 A * 11/1997 Popp et al. ..... 427/421
5,876,502 A * 3/1999 Sugimura et al. ..... 118/712
6,235,350 B1 * 5/2001 Collin et al. ..... 427/8
6,401,976 B1 * 6/2002 Estelle et al. ..... 222/52
6,520,382 B2 * 2/2003 Estelle et al. ..... 222/146.1

OTHER PUBLICATIONS

Nasa Tech Briefs, *Current–Signature Sensor for Diagnosing Solenoid Valves*, Sep., 2001.

* cited by examiner

*Primary Examiner*—Chris Fiorilla
*Assistant Examiner*—George Koch
(74) *Attorney, Agent, or Firm*—Wood, Herron & Evans, L.L.P.

(57) ABSTRACT

An apparatus for operating a fluid dispensing gun to dispense a fluid onto a substrate moving relative to the dispensing gun. The apparatus has a sensor that produces a sensor feedback signal in response to the fluid dispensing gun changing operating states. A control is connected to the sensor and provides first signals causing the fluid dispensing gun to change operating states. The control has a detector producing a compensation signal representing a difference between the occurrences of one of said first signals and the sensor feedback signal. The control then adjusts a subsequent first signal in response to the compensation signal. Thus, the control automatically compensates the operation of the fluid dispensing gun in real time for changes in the switching time of the fluid dispensing gun required to change its operating states.

11 Claims, 6 Drawing Sheets

FLUID DISPENSER WITH AUTOMATIC COMPENSATION AND METHOD

FIELD OF THE INVENTION

The present invention generally relates to a liquid dispenser and a method for dispensing fluids and more specifically, to a fluid dispenser having an automatic compensation that improves performance.

BACKGROUND OF THE INVENTION

The ability to precisely dispense a fluid, for example, a hot melt or cold adhesive or glue, is a necessity for manufacturers engaged in the packaging and plastics industries. Various fluid dispensers have been developed for the placement of fluids, for example, adhesives, coatings, etc., onto a substrate, for example, a carton flap, being supported by a moving conveyor. The speed of the conveyor, or line speed, is set according to such factors as the complexity of the dispensing pattern and the configuration of the gun. Adhesive is normally supplied to the dispensing gun under pressure by a motor driven pump. In such applications, it is important that fluids be dispensed and applied at precise locations or positions on the moving substrate. Fluid that is dispensed too soon or too late and therefore dispensed at other than a desired location can adversely impact subsequent operations on the product and/or result in a lower quality or scrap product.

The time required to open and close the fluid dispensing gun, that is, the dispensing gun switching time, creates a delay in the fluid dispensing process that can cause inaccuracies in the fluid dispensing process. For example, a conveyor moving at 500 feet per minute will move 0.008 inches in one millisecond (ms). If a pneumatic solenoid-operated dispensing gun takes 25 ms to open, the substrate will have moved 0.200 inches after the dispensing gun is commanded to open but before any fluid is dispensed from the dispensing gun. Thus, the adhesive is deposited onto the substrate at a different location than anticipated, and such shifts in the location of the adhesive reduces the quality of the fluid dispensing process and may result in scrap product.

The quality of the fluid dispensing process is also adversely affected by variations in the dispensing gun switching time when the dispensing gun is commanded to close. At the end of a dispensing process, a lengthening of the switching time of the dispensing gun results in adhesive being dispensed for a longer period of time than desired and hence, at a different location than anticipated. Similarly, a shortened switching time can result in a lower quality fluid dispensing process and a scrap part or product.

In order to improve the speed and reliability of the fluid dispensing process, more recent years have seen the development of an electrically operated fluid dispenser or gun. Generally, electrically operated fluid dispensers have an electromagnetic coil surrounding an armature that is energized to produce an electromagnetic field with respect to a magnetic pole. The electromagnetic field is selectively controlled to open and close a dispensing valve by moving a valve stem connected to the armature. More specifically, the forces of magnetic attraction between the armature and the magnetic pole move the armature and valve stem toward the pole, thereby opening the dispensing valve. At the end of a dispensing cycle, the electromagnet is de-energized, and a return spring returns the armature and valve stem to their original positions, thereby closing the dispensing valve. By operating a dispensing gun coil at higher voltages, for example, over 40 VAC, the operational speed of the electric fluid dispensing gun is increased.

However, even with a greater speed of operation, a finite period of time, for example, 10 ms, is required to energize a magnetic field with the gun coil and move the valve to its open position. That period of time represents a delay in the application of fluid onto the moving substrate; and depending on the conveyor speed, that short delay also causes inaccuracies in the desired placement of fluid on the substrate. There is a continuing market pressure to provide faster conveyor speeds, for example, 1000 feet per minute and more, without any loss of quality in the fluid dispensing process. Clearly, as conveyor speeds increase, the effect of variations in the gun switching time becomes more important. Therefore, known controls for fluid dispensing guns have a manually adjustable input that is used by an operator to provide a fixed, gun on compensation value. For example, the gun coil switching time can be measured and used as a compensation value that is entered by the operator before initiating a fluid dispensing cycle. The gun control uses the gun on compensation value to advance a start of a fluid dispensing cycle, that is, the time at which the gun coil is turned on or energized. Thus, after the delay caused by the gun coil switching time, fluid is dispensed from the gun at a time that results in a more accurate deposition of fluid onto the substrate.

In many applications, that fixed compensation value provides a satisfactory fluid dispensing process. However, in some applications, the operator may observe that the placement of the fluid is not accurate. In those applications, the operator can again use the manually adjustable input to change the compensation value and thus, more accurately locate the placement of the fluid on the substrate.

The same issues arise when the fluid dispensing gun is turned off. It should be noted that the fluid dispensing valve is opened by operation of the gun coil, whereas the fluid dispensing valve is closed by the operation of a return spring. Therefore, the switching times required to open and shut the fluid dispensing valve are often different. The increment of time required for the magnetic field in the gun coil to dissipate and the return spring to shut off the valve is measurable and can be manually input into the fluid dispensing control as a fixed, gun off compensation value. The gun control uses that compensation value to advance an ending of the fluid dispensing cycle, that is, the time at which the gun coil is turned off or de-energized. Thus, after the delay to shut the dispensing valve off, fluid ceases to be dispensed from the gun at a time that results in an accurate termination of the fluid dispensing process.

Although known fluid dispensing systems operate satisfactorily in many applications, the dispensing gun switching time can be adversely impacted by many different factors. For example, variations in the switching time of the dispensing gun can be caused by variations in fluid viscosity or variations in line voltage being supplied to the dispensing system control. Further, mechanical wear and aging of components within the dispensing gun can impact gun switching time. For example, a return spring is often used to move the dispensing valve in opposition to a solenoid. Over its life, the spring constant of the return spring changes, thereby changing the rate at which the dispensing valve opens and closes and hence, the location of dispensed adhesive on a substrate. Further, the accumulation of charred adhesive within the dispensing gun over its life often increases frictional forces on the dispensing valve, thereby changing gun actuation time. Thus, for the above and other reasons, the operation of the dispensing gun is subject to many changing physical forces and environmental conditions that cause variations in the actuation time of the dispensing gun. Such variations in dispensing gun switching times produce variations from desired locations of adhesive deposits on the moving substrate.

Thus, known compensation techniques for fluid dispensing systems have several disadvantages. First, if the initial compensation value is not accurate, a better compensation value requires that production be run in a trial and error process until the desired compensation is determined. Such a process is an inefficient and uneconomical use of the production line, and scrap product is often being produced during this tuning process. Second, if, during production, there are any changes in the components of the fluid dispensing gun that change its operating time, the placement of the fluid on the substrate will drift. Any drift in the switching time of the fluid dispensing gun often results in a less accurate fluid dispensing process and hence, a poorer quality product.

Thus, there is need for a fluid dispensing system that automatically corrects for any variations in the switching time of the fluid dispensing gun.

SUMMARY OF THE INVENTION

The present invention provides a fluid dispensing system that automatically provides a more accurate fluid dispensing process. The fluid dispensing system of the present invention continuously monitors the operation of the fluid dispensing gun and continuously adjusts the dispensing process so that fluid is accurately dispensed onto the substrate. Thus, the fluid dispensing system of the present invention automatically and consistently dispenses fluid at a desired location on a moving substrate independent of changes in the switching times of the dispensing gun that would otherwise adversely impact the quality of the fluid dispensing process. The capability of automatically monitoring the switching time of the fluid dispensing gun and compensating for changes in the gun switching time also permits a wider variety of fluid dispensing guns to be used to accurately dispense fluid onto a moving substrate. For example, with the present invention, fluid dispensing guns having slower gun switching times can be used to more accurately dispense fluid onto a moving substrate. Slower switching fluid dispensing guns are often less expensive, and therefore, the present invention has a further advantage of obtaining a higher quality fluid dispensing process from a lower cost fluid dispensing system. In addition, the capability of quantifying in real time gun switching time is also a useful input to diagnostic and quality control systems.

According to the principles of the present invention and in accordance with the described embodiments, the invention provides an apparatus for operating a fluid dispensing gun to dispense a fluid onto a substrate moving relative to the dispensing gun. The apparatus has a control that provides first signals causing the fluid dispensing gun to change operating states, and a sensor produces a sensor feedback signal in response to the fluid dispensing gun changing operating states. The control has a detector producing a compensation signal representing a difference between the occurrences of one of the first signals and the sensor feedback signal. The control then adjusts a subsequent first signal in response to the compensation signal.

In one aspect of this invention, the sensor senses a presence of fluid deposited on the substrate. In another aspect of this invention, a coil having an armature operates the fluid dispensing gun; and the sensor produces the sensor feedback signal in response to motion of the armature causing the change of dispensing gun operating state. In a still further aspect of this invention, the sensor produces the sensor feedback signal in response to a change in current flow in the coil representing the change of dispensing gun operating state.

In another embodiment of the invention, a method is provided for operating a fluid dispensing gun to dispense a fluid onto a substrate moving relative to the dispensing gun. The dispensing gun changes operating states in response to signals from a fluid dispensing control. With the method, a first signal is applied to the dispensing gun to command a change of operating state. Next, the change of operating state of the fluid dispensing gun is detected. A difference is then detected between the application of the first signal and the detection of a change in the operating state of the fluid dispensing gun. An application of a subsequent signal to the dispensing gun is then adjusted in response to the difference.

In one aspect of this invention, a physical characteristic produced by the dispensing gun changing state is detected. In another aspect of this invention, a feature of a fluid deposit applied to the moving substrate in detected. In a further aspect of this invention, a coil having an armature operates the fluid dispensing gun; and motion of the armature is detected. In a still further aspect of this invention, changes in a current flow in the coil caused by the fluid dispensing gun changing state is detected.

These and other objects and advantages of the present invention will become more readily apparent during the following detailed description taken in conjunction with the drawings herein

DETAILED DESCRIPTION OF THE INVENTION

Figure 1:
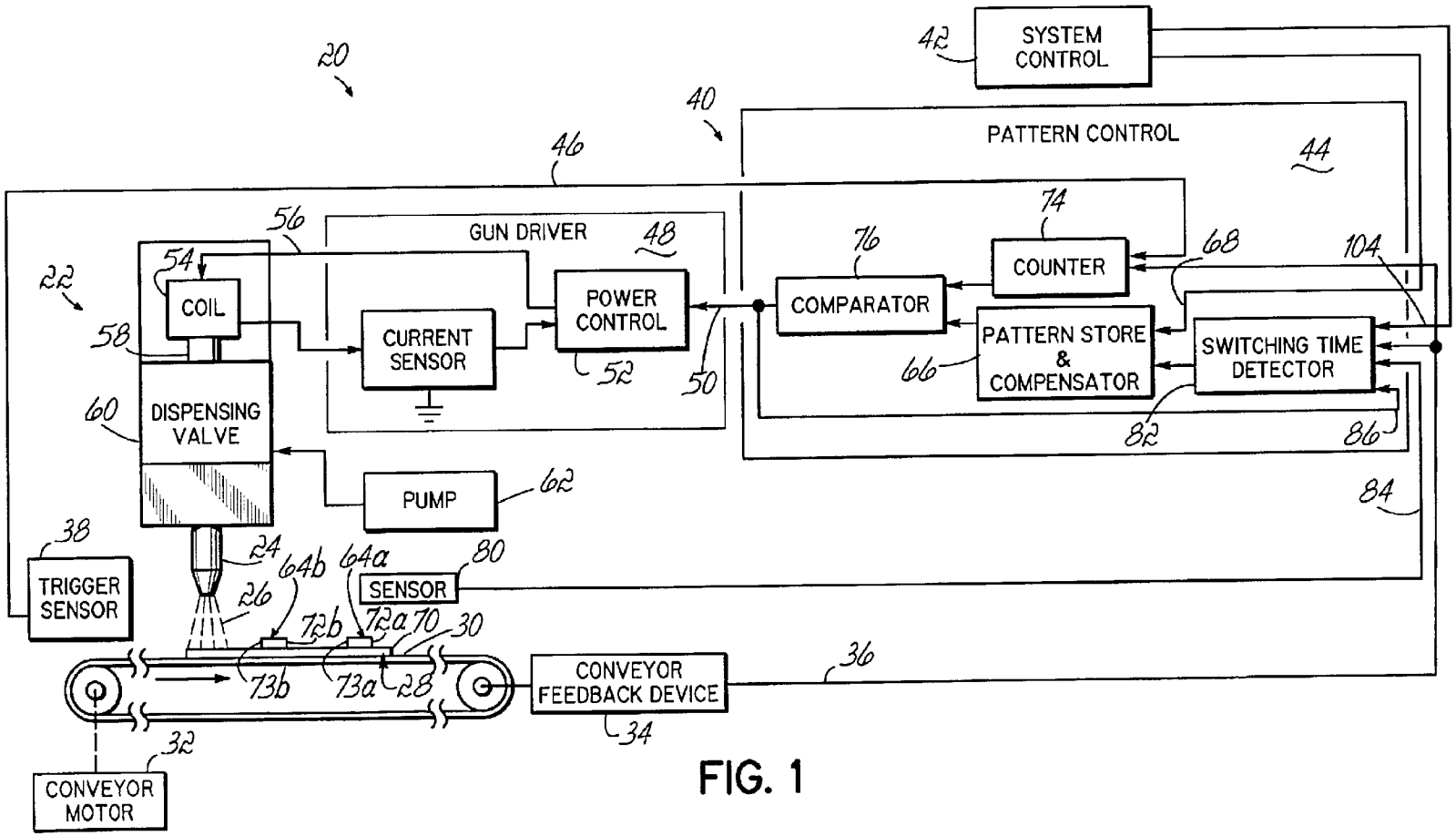
FIG. 1 is a schematic block diagram of one embodiment of a fluid dispensing system having a compensation system in accordance with the principles of the present invention.

Referring to FIG. 1, a fluid dispensing system 20 is comprised of a fluid dispensing gun 22 having a nozzle 24 for dispensing a fluid 26, for example, a hot melt or cold adhesive or glue, onto a part or substrate 28. A conveyor 30 carries the substrate 28 past the dispensing gun 22. The conveyor 30 is mechanically coupled to a conveyor drive having a conveyor motor 32. A conveyor feedback device 34, for example, an encoder, resolver, etc., is mechanically coupled to the conveyor 30 and detects conveyor motion. The feedback device 34 has an output 36 providing a feedback signal that changes as a function of changes in the conveyor position. For example, the feedback signal may provide a discrete pulse for each incremental displacement of the conveyor 30.

A fluid dispensing control 40 has a system control 42 that generally functions to coordinate the operation of the overall fluid dispensing system 20. For example, the system control 42 often controls the operation of the conveyor motor 32 and also provides a system user input/output interface (not shown) in a known manner. Further, the system control 42 operates in conjunction with a pattern control 44 that controls the operation of the fluid dispensing gun 22 as a function of a particular application and/or part being run. The pattern control 44 receives, on an input 46, a part present or trigger signal from a trigger sensor 38. The trigger sensor is positioned to detect a feature, for example, a leading edge, of the part 28 moving on the conveyor 30. The trigger sensor 38 often provides a signal transition upon detecting the part feature and thus, provides an ability to synchronize other operations with the motion of the part 28 on the conveyor 30.

In response to the trigger signal, the pattern control 44 provides a sequence of gun on/off signals in the form of pulses to a gun control or driver 48 via an input 50. In the described embodiment, each of the gun on/off signals has respective leading and trailing edges representing desired changes in the operating state of the dispensing gun 22. The leading edges command or initiate a change of state that turns on or opens the fluid dispensing gun 22, and the trailing edges command or initiate a change of state that turns off or closes the fluid dispensing gun 22. Thus, the leading and trailing edges of the gun on/off signals from the pattern control 44 represent, respectively, gun on and gun off operating state transitions of the dispensing gun 22.

A power control 52 within a gun driver 48 is responsive to the gun on/off signals and provides output signals to a dispensing gun coil 54 via an output 56. The switching time of the power control 52 is very small when compared to the switching time of the fluid dispensing gun 22; and therefore, for purposes of this invention, the switching time of the power control 52 can be ignored. The output signals energize and de-energize the gun coil 54 to operate the dispensing gun 22 as a function of the timing and duration of the gun on/off pulses from the pattern control 44. Thus, the output signals also command or cause the dispensing gun to change states. The dispensing valve 60 is fluidly connected to a pump 62; and the pump 62 receives fluid, for example, an adhesive, from a reservoir (not shown). Upon the dispensing valve 60 opening, pressurized adhesive in the dispensing gun 22 passes through the nozzle 24 and is applied to the substrate 28 as a fluid deposit 64, for example, a dot, bead, strip, etc.

The dispensing valve 60 remains open for the duration of the gun on/off pulse; and in response to the trailing edge of a gun on/off pulse, that is, a gun OFF transition, the gun driver 48 terminates current flow through the gun coil 54. The magnetic field around the armature 58 collapses, and the dispensing valve 50 is closed by a return spring (not shown) in a known manner.

The pattern control 44 has a pattern store and compensator 66 that receives and stores a fluid dispensing pattern from the system control 42 via input 68. The fluid dispensing pattern is entered into the system control 42 in a known manner. The fluid dispensing pattern represents a series of fluid dispensing cycles associated with a part 28 that result in a desired pattern of fluid deposits 64 thereon. The fluid dispensing pattern is often represented by numerical quantities or values in the pattern store 66 that are a measure of distances on the part 28 from a feature such as its leading edge 70 to leading and trailing edges 72, 73, respectively, of a fluid deposit 64. A counter 74 within the pattern control 44 is electrically connected to the conveyor feedback device 34 and the trigger sensor 38 and accumulates a numerical value representing motion of the substrate 28 after its leading edge 70 has been detected.

Assuming no pattern compensation, a comparator 76 is responsive to a first numerical value from the pattern store 66 representing a distance from the leading edge 70 of the substrate 28 to a first leading edge 72*a* of the first adhesive deposit 64*a*. The comparator 76 is responsive to a second numerical value in the counter 74 representing motion of the substrate 28 after its leading edge 70 has been detected. When the comparator detects a relationship between those two values, for example, a substantial equality, the comparator 76 provides a gun ON transition from the pattern control 44 to the gun driver 48. The gun driver 48 turns on or opens the fluid dispensing gun 22, and fluid is deposited onto the substrate 28. The counter 74 continues to count the feedback pulses from the conveyor feedback device 34, and the pattern store 66 presents the next stored value to the comparator. That next value determines the time at which the fluid dispensing gun should be turned off and represents the location of the trailing edge 73*a* of the first fluid deposit 64*a* as measured from the leading edge 70 of the substrate 28. When the comparator 76 detects a relationship between those two quantities, for example, a substantial equality, it provides a gun OFF transition to the gun driver 48; and the gun driver 48 causes the fluid dispensing gun 22 to shut off or close, thereby terminating the dispensing of fluid onto the moving substrate 28.

The fluid dispensing system of FIG. 1 has a compensation system that includes a sensor 80 and a switching time detector 82. The sensor 80 is mounted with respect to the conveyor 30 so that the sensor 80 can sense, and provides a sensed or sensor feedback signal representative of, one or more edges 72, 73 of respective adhesive deposits 64 as the conveyor 30 moves the substrate 28. The sensor 80 is any sensor capable of reliably providing a high speed indication of the one or more edges 72, 73, for example, an infrared sensor, dielectric sensor, laser sensor, etc. The switching time detector 82 has inputs 84, 86 electrically connected to respective outputs of the sensor 80 and the comparator 76 and is used to detect or measure the switching time or delay of the fluid dispensing gun 22. As will be appreciated, the switching time detector input 86 can alternatively be responsive to output 56 of the gun driver 48; however, the signal on the output 56 is a high current signal and therefore, is more difficult to use as a transition reference. The detector 82 provides a compensation signal or value representing the detected delay that is used by the pattern store 66 to compensate the numerical values presented to the comparator 76, so that gun ON/OFF transitions are automatically and continuously shifted in real time to eliminate the adverse effects of dispensing gun switching time. Therefore, fluid is more reliably and accurately deposited on the moving substrate 28.

Figure 2A:
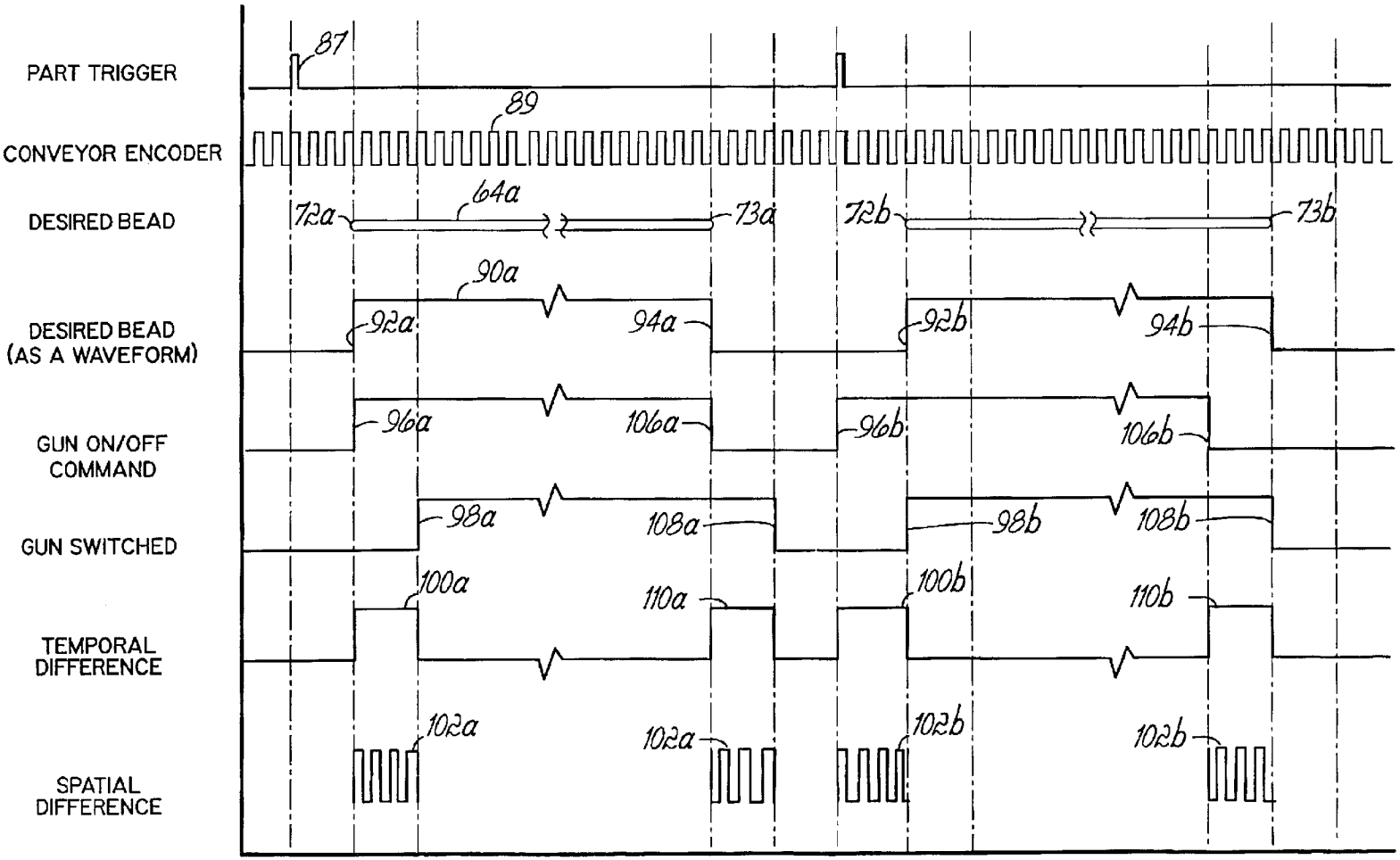
FIGS. 2A and 2B are waveform timing diagrams illustrating an operation of the compensation system of FIG. 1.

In use, a user enters a particular pattern of fluid deposits 64 utilizing the system control 42. That pattern is then downloaded via line 68 to the pattern store 66. The capability of the pattern control 44 to store one or more patterns over one or more dispensing cycles will depend on the application and the type of fluid dispensing control 40 being utilized. The user then, via the system control 42, commands the conveyor motor 32 to start, thereby moving the substrate 28 on the conveyor 30 toward the fluid dispensing gun 22. When the trigger sensor 38 detects the leading edge 70 of the substrate 28, a trigger signal 87 of FIG. 2A is provided to the counter 74. The counter 74 then begins to accumulate pulses 89 from the conveyor feedback device 34 and thus, the counter 74 accumulates a numerical value representing the displacement of the conveyor 30 with respect to the leading edge 70 of the substrate 28.

The pattern store 66 presents a first numerical value to the comparator 76 representing the distance from the leading edge 70 of the substrate 28 to the leading edge 72*a* of the first deposit 64*a*. When the comparator 76 determines that the substrate 28 has moved through a displacement substantially equal to the first numerical value, the comparator 76 provides a leading edge of a gun on/off pulse, that is, a gun ON transition to the power control 52. The power control 52 provides an output signal that energizes and changes the state of the gun coil 54. A leading edge of an output signal from the gun driver 48 creates current flow through the gun coil 54, thereby building up a magnetic field that lifts an armature 58 and a dispensing valve 60 connected thereto. As noted, a finite time is required to open the dispensing valve 60 and apply a fluid 26 as a leading edge 72*a* of the deposit 64*a* on the moving substrate 28.

The deposit 64*a* (FIG. 2A) can be represented as a waveform 90*a* that has respective leading and trailing edges 92*a,* 94*a* that correspond to the respective leading and trailing edges 72*a,* 73*a* of the fluid deposit 64*a*. If the fluid dispensing gun switching time were zero, then the gun ON transition 96*a* would correspond to the leading edge 92*a* and thus, produce a leading edge 72 of fluid on the substrate 28. However, the delay between the actuation of a dispensing valve 60 and the deposition of the leading edge 72*a* onto the substrate 28 changes the desired location of the leading edge 72*a*.

That delay is detected or measured by the switching time detector 82. Upon detecting the leading edge 72*a* of the fluid deposit 64*a,* the sensor 82 provides an edge feedback signal represented by transition 98*a* to the switching time detector 82. The detector 82 is also responsive to the gun ON transition 96*a* provided by the comparator 76. Thus, the switching time detector 82 detects or measures a difference or delay between the transitions 96*a* and 98*a*. That delay can be represented in a time domain by a pulse 100*a* or represented in a spatial domain by a count of feedback pulse transitions 102*a* from the conveyor feedback device 34 occurring between the transitions of the pulse 100*a*.

That measured delay or difference represents a real time delay between a command to open the dispensing gun 22 and the deposit of fluid onto the moving substrate 28. The measured delay in either of its forms 100*a,* 102*a* is provided to the pattern store 66 where it is used to adjust or modify the values representing the desired fluid dispensing pattern. In the present example, a stored pattern value representing the next leading edge 72*b* of the substrate 64*b* is compensated by the detected delay 100*a,* 102*a*. Therefore, the pattern store 66 presents a numerical value to the comparator 76 that, in essence, advances the location of the leading edge 72*b* by the measured delay time 100*a,* 102*a*. Therefore, the comparator 76 produces a gun ON transition 96*b* that is advanced by the measured delay 100*a,* 102*a*. The, current is applied to the dispensing gun coil 54 in advance; and assuming that the gun switching time has not changed appreciably since the prior operation, the sensor 80 detects the leading edge 72*b* of the fluid deposit 64*b* at a time represented by the transition 98*b*. Thus, the deposition of fluid 26 onto the substrate 28 occurs at its desired time or location as represented by the transition 92*b*. The measured delay 100*a,* 102*a* for each gun ON transition is used by the pattern store 66 to compensate a subsequent gun ON transition, thereby depositing or placing the leading edges 72 of subsequent respective fluid deposits 64 to their respective desired locations on the moving substrate 28.

As discussed earlier, in many applications, environmental and other factors cause the gun switching time to vary or drift with time, and that, in turn, causes leading edges 72 of respective fluid deposits 64 to also change or drift. That drift in the location of the leading edges 72 on the substrate 28 is detected by the switching time detector 82 and used by the pattern store 66 as earlier described to continuously shift the gun ON transition 96. Thus, the location of the leading edges 72 of subsequent respective fluid deposits 64 are maintained at their desired relative locations on the moving substrate 28.

Referring to FIG. 2A, the initial gun ON transition 96*a* results in a shift in the location of the leading edge 72*a* of the fluid deposit 64*a* from its desired location as represented by the transition 92*a* to a location represented by the transition 98*a*. Thus, the shifted fluid deposit 64*a* is an example of a poorer quality fluid deposit and may result in a scrap product. In order to minimize that shift, the user can input, via the system control 42, a fixed compensation value representing an estimate of the switching time of the dispensing gun 22. That initial compensation value C1 is provided to the pattern control 44 via input 104 where it is stored. Further, referring to FIG. 2B, that initial compensation value is utilized by the pattern store 66 to advance the leading edge 72*a* of the first fluid deposit 64*a*. Therefore, the comparator 76 provides a gun ON transition 96*c* that is also advanced by the amount of the initial compensation value C1.

The advanced gun ON transition 96*c* results in the edge sensor 80 providing a transition 98*c* representing the leading edge 72*a* at a point that is closer to the desired location as represented by the transition 92*a*. Further, the switching time detector 82 provides a pulse 100*c* representing the time between the transitions 96*c* and 98*c;* and as indicated at 102*c,* that time delay can be represented in terms of encoder pulse transitions. Thus, with an initial fixed compensation value, the initial leading edge 72*a* can be placed closer to its desired location. Further, in the example of FIG. 2B, the initial compensation value C1 is not equal to the gun switching time. However, the switching time detector 82 measures a delay that does represent the gun switching time; and that delay is used to compensate the next leading edge 72*b* as earlier described.

Figure 2B:
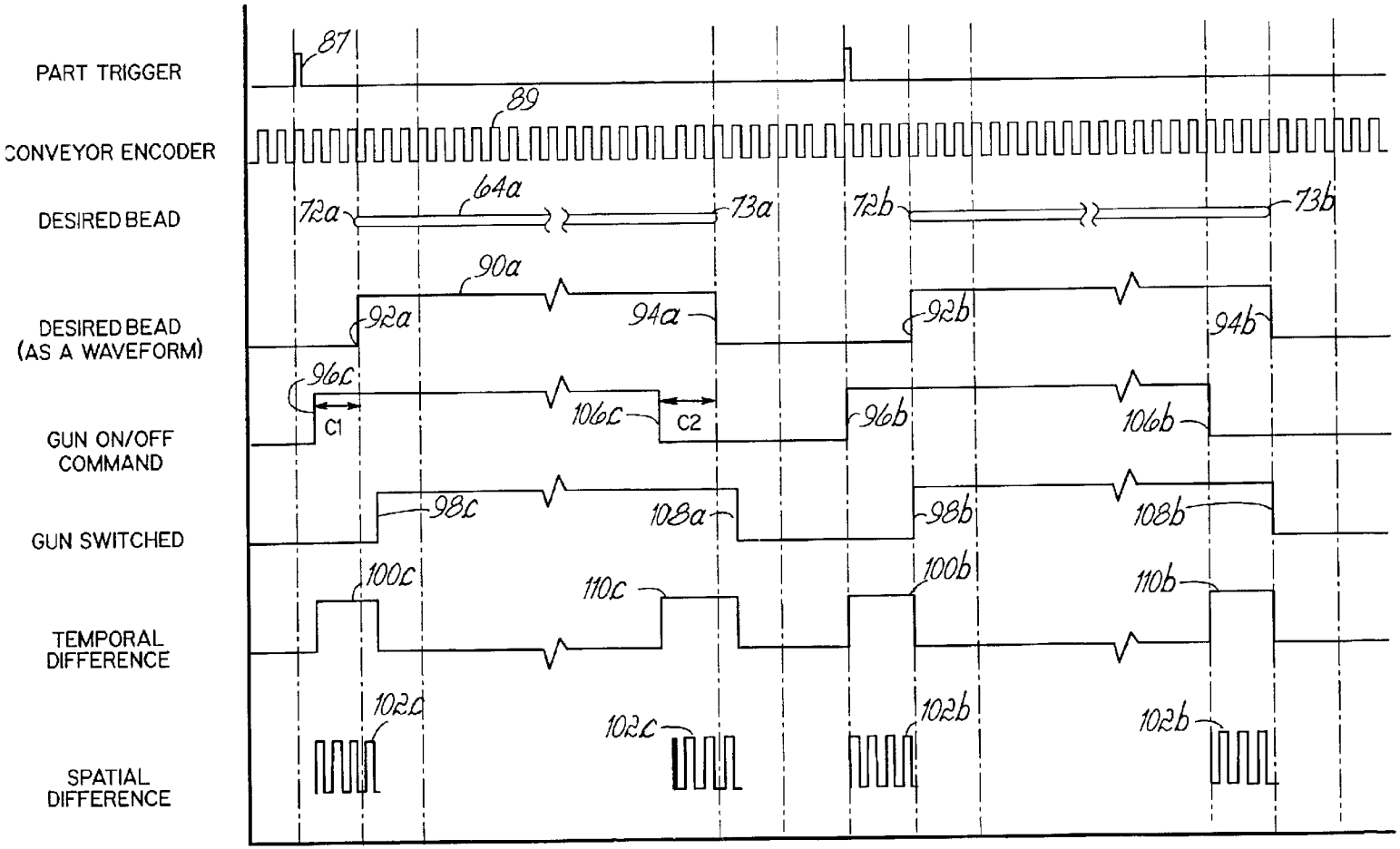

The above examples illustrated in FIGS. 2A and 2B provide a compensation for leading edges 72 of fluid deposits 64 arising from variations in the dispensing gun switching time. As will be appreciated, the sensor 80, switching time detector 82 and pattern store 66 can be used to provide a similar compensation to the gun OFF transition so that the trailing edges 73 of respective deposits 64 are precisely located on the moving substrate 28. For example, referring to FIG. 2A, an initial gun OFF transition 106*a* is provided at a time representing the desired location of the trailing edge as represented by the transition 94*a*. Upon detecting the trailing edge 73*a* on the moving substrate 28, the sensor 80 provides a feedback signal represented by the edge 108*a*. The switching time detector 80 measures the turn off delay of the fluid dispenser 22 and provides a delay signal to the pattern store 66 as represented by the waveforms 110*a,* 112*a*.

The pattern store 66 then compensates the next trailing edge 73*b* by compensating or advancing the numerical value representing the trailing edge 73*b* stored therein. In a manner similar to that earlier described, the comparator then advances the gun OFF transition 106*b* by an amount substantially equal to the measured delay 1101, 112*a*. Therefore, assuming the switching time has not changed, the sensor 80 detects an occurrence of the trailing edge 73*b* at a time corresponding to its desire location. Thus, the sensor 80 produces an edge feedback signal represented by the transition 108*b* that corresponds to the desired edge location as represented by transition 94*b*.

As with the leading edge of the initial deposition 64*a*, the initial trailing edge 108*a* is shifted from its desired position as represented by the transition 94*a*. Therefore, referring to FIG. 2B, a user defined and input fixed compensation value C2 can be used to provide an initial compensation for the trailing edge 73*a*. Thus, the gun OFF transition 106*c* is advanced by the magnitude of the initial compensation C2, and the resulting trailing edge is placed at a location closer to the position 94*a* as represented by the transition 108*c*. Further, the measured delay as represented by the waveforms 110*c*, 112*c* accounts for the full turn off switching time of the dispensing gun 22, so that the subsequent trailing edge 73*b* is placed at its desired location as represented by the transition 108*b*.

With some fluid dispensing guns, the turn-on and turn-off switching times may be substantially equal, and therefore, the gun on switching time can be used to compensate the gun OFF transition. Similarly, the measured delay in turning the dispensing gun off may be used to compensate the gun ON transition. However, with many fluid dispensers the turn on switching time will be substantially different from the turn off switching time. In those applications, the pattern store 66 is used to separately store the turn on and turn off switching times or delays. With any of the embodiments, during production runs, any changes caused by a drifting of the switching times, may be used to compensate the gun ON and gun OFF transitions as appropriate.

Figure 3:
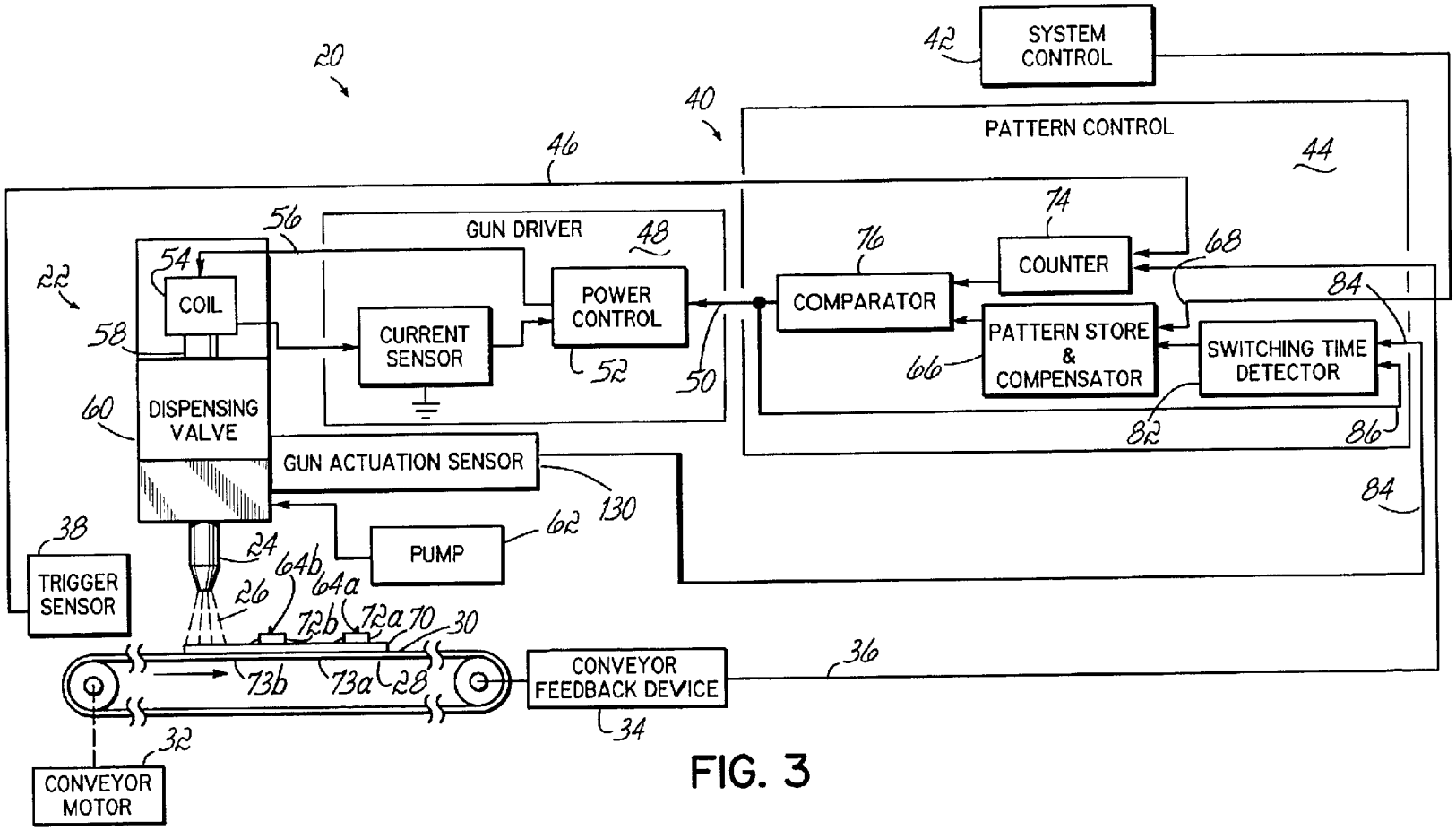
FIG. 3 is a schematic block diagram of another embodiment of the compensation system for the fluid dispensing system of FIG. 1.

In some applications, it may not be practical to use an edge sensor 80, and therefore, other devices and methods may be used to detect and measure the switching time of the dispensing gun 22. For example, referring to FIG. 3, a gun actuation or switching sensor 130 may be used to detect the mechanical actuation of the dispensing valve 60 in switching from its off state to its on state. The gun actuation sensor 130 may be implemented using an accelerometer, for example, that detects motion of the armature 58 and/or valve stem (not shown) connected to the armature 58 within the dispensing valve 60. When the gun ON transition causes the gun driver 48 to provide current to the coil 54, a magnetic field builds up and shifts the armature 58 in a direction causing the dispensing valve 60 to open. The armature moves through a short linear stroke. Upon the magnetic field causing the armature to move, the gun actuation sensor 130 provides a sensed or sensor feedback signal to an input 84 of the switching time detector 82 as represented by the waveform 114 of FIG. 5.

Figure 5:
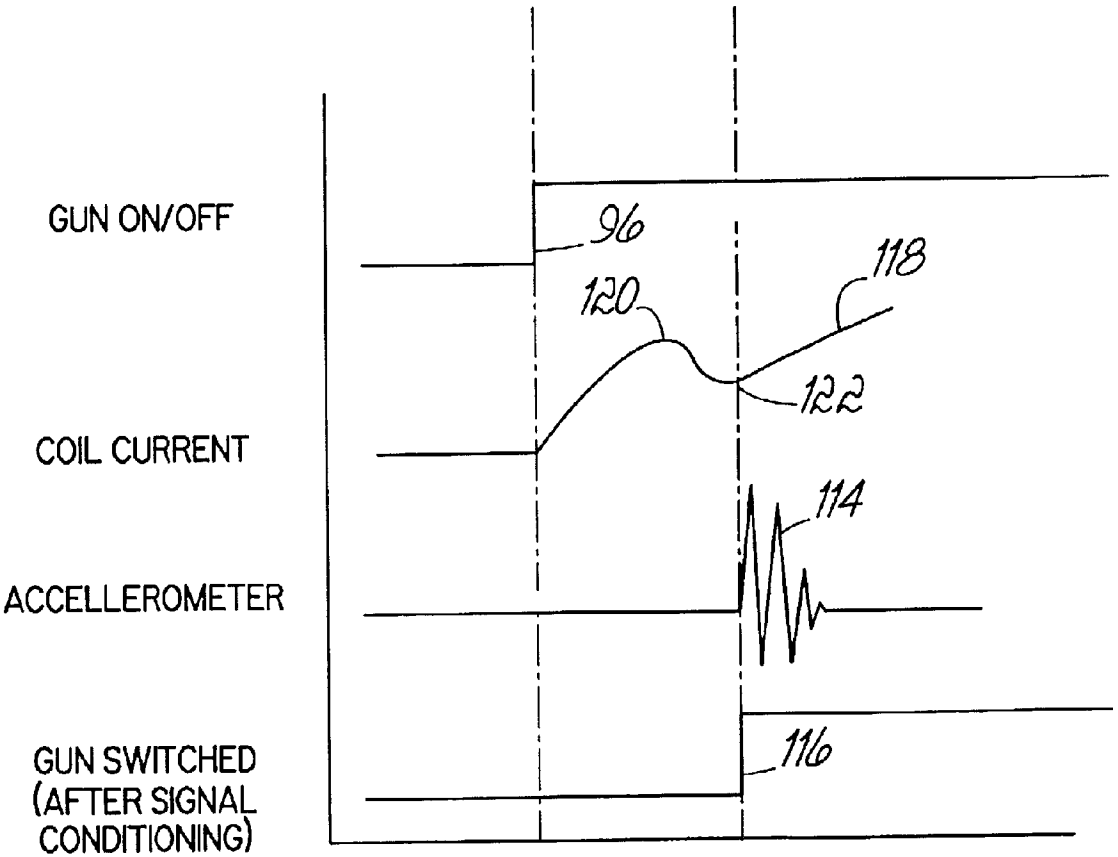
FIG. 5 is a waveform timing diagram illustrating the operation of the gun actuation sensors of FIGS. 3 and 4.

When the armature 58 reaches the end of its stroke and its velocity is zero, the output from the gun actuation sensor 130 drops rapidly back to its initial state. Signal conditioning in the gun actuation sensor 130 or the switching time detector may use a peak detector to detect the maximum amplitude of the waveform 114 (FIG. 5). The peak value of the waveform 114 occurs instantaneously before the armature 58 reaches the end of its stroke. Thus, the peak value of the accelerometer signal in essence detects when the dispensing valve is open. Further signal conditioning can be used to create a transition 116. The switching time detector 82, in a manner similar to that described before, detects or measures the delay between the initiation of the gun on signal from the comparator 76 and the occurrence of the transition 116. That delay is used by the pattern store 66 to adjust or compensate the values representing the leading and/or trailing edges 72, 73 of the fluid deposit 64 and hence, the occurrence of the gun ON/gun OFF transitions. In a similar manner, the gun actuation sensor can be used to measure a delay caused by the fluid dispensing gun 22 being switched from its on state to its off state.

Figure 4:
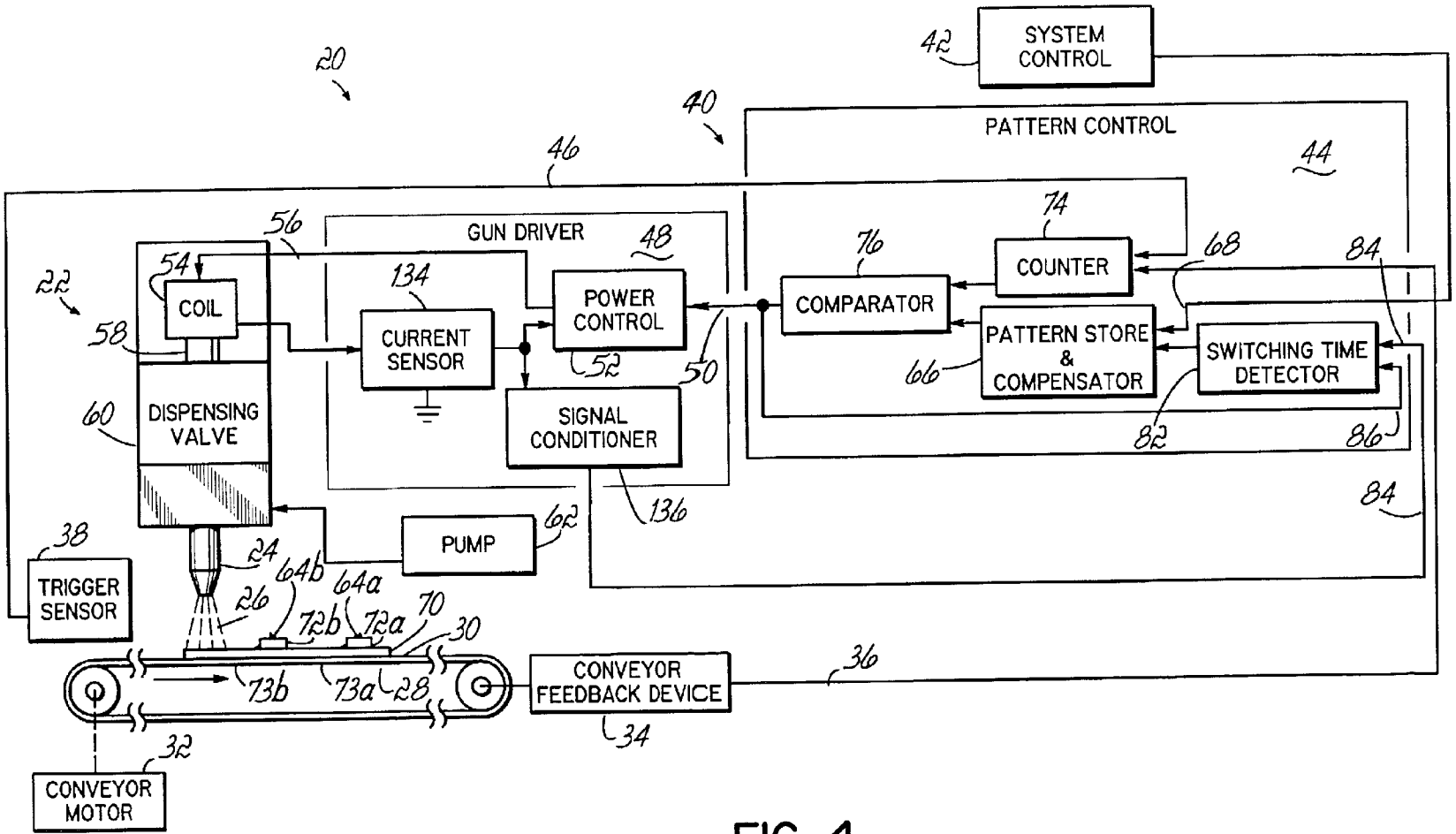
FIG. 4 is a schematic block diagram of a further embodiment of the compensation system for the fluid dispensing system of FIG. 1.

Other applications may lend themselves to a further alternative embodiment. Referring to FIG. 4, many gun drivers 48 contain a current sensor 134 that provides a sensed current feedback signal representing current flow in the coil. The current feedback signal from the sensor 134 is often provided to the power control 52 of the gun driver 48 for current control purposes. In this embodiment, the current feedback signal is also provided to a signal conditioner 136 that, in turn, is connected to the input 84 of the switching time detector 82. The current in the coil 54 has a unique waveform 118 (FIG. 5) in which the magnitude of the current reaches a peak 120 and then drops to a null 122 before increasing again. The null 122 in current magnitude is caused by the magnetic field pulling the armature 58 away from a pole (not shown). The separation of the armature 58 from the pole effectively changes the inductance of the coil 54, thereby producing the null 122. The signal conditioner 136 often provides some filtering and in addition, detects the null 122 and provides a transition as represented by the transition 116. As will be appreciated, the signal condition may be provided in the switching time detector 82. The null 122 can be detected in any appropriate manner. However, in one embodiment, the derivative of the current feedback signal can be continuously monitored, and the null 122 is represented by a second occurrence of a zero value of that derivative.

The fluid dispensing system 20 continuously monitors the switching time of the fluid dispensing gun and automatically adjusts the operation of the gun driver 48 in real time, so that fluid is accurately dispensed onto the moving substrate 28. This consistency in the fluid dispensing process reliably provides a high quality finished product. The capability of automatically measuring and compensating of variations in the switching time of the fluid dispensing gun also permits a wider variety of fluid dispensing guns to be used to accurately dispense fluid onto a moving substrate. For example, with the compensation described herein, fluid dispensing guns having slower gun switching times can be used to more accurately dispense fluid onto a moving substrate. In some applications, low voltage solenoid-operated guns can be considered for use when such was not possible without the compensation system described herein. This advantage is significant because slower switching, low voltage fluid dispensing guns are often less expensive.

The compensation system described herein has a further advantage in that it allows more flexibility in connecting a particular pattern control with different gun drivers. Further, since the compensation system provides more flexibility to a pattern control and gun driver combination, it is now feasible to integrate the design of a pattern control and gun driver into a single unit.

A still further advantage of the compensation system herein is that it is no longer necessary to design fluid dispensing guns having shorter and shorter switching times in order to adapt to ever increasing conveyor speeds. In addition, the capability of quantifying in real time gun switching time is also a useful input to diagnostic and quality control systems. Thus, the capability of a switching time compensation system to continuously adjust the fluid dispensing process in real time presents unique opportunities to improve the quality and economy of a fluid dispensing process.

While the present invention has been illustrated by a description of various embodiments and while these embodiments have been described in considerable detail in order to describe a mode of practicing the invention, it is not the intention of Applicant to restrict or in any way limit the scope of the appended claims to such detail. Additional advantages and modifications within the spirit and scope of the invention will readily appear to those skilled in the art. For example, in the described embodiments, the switching time detector is located in pattern control 44; however, as will be appreciated, in an alternative embodiment, the switching time detector may be integrated into the gun driver 48 or any other part of the system control 40.

In the described embodiments, the frequency of computation of the compensation signal or value and adjustment of the signals from the control system 40 is not specified. As will be appreciated, the frequency of signal adjustments can vary from application to application. For example, a compensation value can be computed and an output signal from the gun driver 48 adjusted with each change of state of the fluid dispensing gun 22. In other applications, the output signal from the gun driver can be adjusted at a different rate than the determination of compensation values. Further, the determination of compensation values and/or adjustment of output signals can occur after timed periods, after measured conveyor displacements, after a number of dispensing cycles, etc. In other applications, the output signals may be adjusted only after detecting a particular magnitude of change in the compensation value.

In the described embodiments, the examples used result in the gun ON/OFF transition and corresponding output signals being advanced in time. As will be appreciated, environmental or other changes in the operation of the dispensing gun may result in the gun switching time in one fluid dispensing cycle decreasing from what it was in a prior dispensing cycle. In that event, the gun ON/OFF transition and output signal from the gun driver 48 are adjusted in an opposite direction or retarded in time in response to the compensation signal.

In the described embodiments, each embodiment has a sensor providing a sensor feedback signal that can be used to compensate for the dispensing gun switching time in turning the dispensing gun on and off. As will be appreciated each sensor has its benefits and drawbacks. For example, in the embodiment of FIG. 4, a coil current sensor 134 is used to provide a feedback signal with which the compensation value is determined. A current sensor may prove satisfactory in determining a dispensing gun ON switching time because the coil current causes the dispensing valve to open. However, the dispensing valve is often closed by a return spring; and in those applications, current sensing may be less reliable. It is within the scope of the claimed invention to use different and multiple sensors to detect a changes of state of the dispensing gun 22 where each sensor is particularly suited to detect a particular change of state.

Therefore, the invention in its broadest aspects is not limited to the specific details shown and described. Consequently, departures may be made from the details described herein without departing from the spirit and scope of the claims that follow.

What is claimed is:

1. An apparatus for operating a fluid dispensing gun to dispense fluid at a desired location onto a substrate moving relative to the dispensing gun, the dispensing gun being operated by a gun driver and requiring a switching time to change operating states, the apparatus comprising:

a first sensor for detecting a feature of the substrate as it moves relative to the fluid dispensing gun prior to the fluid dispensing gun dispensing fluid onto the substrate;

a feedback device for detecting relative motion between the substrate and the fluid dispensing gun;

a counter connected to said first sensor and said feedback device for measuring the relative motion between the substrate and the fluid dispensing gun in response to said first sensor detecting the feature of the substrate;

a pattern store for storing data relating to a series of fluid dispensing cycles;

a comparator connected to said counter and said pattern store and providing first signals to the gun driver causing the fluid dispensing gun to execute the series of dispensing cycles;

a second sensor producing a sensor feedback signal representing a detected edge of dispensed fluid on the substrate; and a switching time detector connected to said feedback device, said second sensor and said comparator and measuring the switching time, said switching time detector producing a compensation signal causing the comparator to adjust an application of the first signals to the gun driver, so that the fluid dispensing gun dispenses fluid at the desired location on the substrate.

2. The apparatus of claim 1 wherein each of said first signals has a leading edge initiating a change of state of the fluid dispensing gun, and said pattern store adjusts said leading edge of said one of said first signals in response to said compensation signal.

3. The apparatus of claim 1 wherein each of said first signals has a trailing edge initiating a change of state of the fluid dispensing gun, and said pattern store adjusts said trailing edge of said one of said first signals in response to said compensation signal.

4. The apparatus of claim 1 wherein said sensor produces said sensor feedback signal in response to sensing a leading edge of a fluid deposited on the substrate by the fluid dispensing gun.

5. The apparatus of claim 1 wherein said sensor produces said sensor feedback signal in response to sensing a trailing edge of a fluid deposited on the substrate by the fluid dispensing gun.

6. An apparatus for operating a fluid dispensing gun to dispense fluid at desired locations onto a substrate moving relative to the dispensing gun, the dispensing gun being operated by a coil and requiring a switching time to change operating states, the apparatus comprising:

a gun driver providing output signals to the coil and causing the fluid dispensing gun to dispense fluid onto the substrate;

a first sensor for detecting a feature of the substrate as it moves relative to the fluid dispensing gun prior to the fluid dispensing gun dispensing fluid onto the substrate;

a feedback device for detecting relative motion between the substrate and the fluid dispensing gun;

a counter connected to said first sensor and said feedback device for measuring the relative motion between the substrate and the fluid dispensing gun in response to said first sensor detecting the feature of the substrate;

a pattern store for storing data relating to a series of fluid dispensing cycles;

a comparator connected to said counter and said pattern store and providing first signals to said gun driver to provide said output signals to the coil, thereby executing the series of dispensing cycles;

a current sensor connected to the coil and providing a current feedback signal representing a detected current in the coil; and a switching time detector connected to said feedback device, said current sensor and said comparator and measuring the switching time, said switching time detector producing a compensation signal causing the comparator to adjust an application of said first signals to said gun driver, so that the fluid dispensing gun dispenses fluid at the desired locations on the substrate.

7. The apparatus of claim 6 wherein the substrate is supported on a conveyor moving relative to the fluid dispensing gun and said feedback device further comprises a conveyor feedback device providing a series of pulses, each pulse representing an incremental displacement of the conveyor, and said switching time detector provides said compensation signal as a number of pulses representing a difference between an occurrence of said one of said first signals and an occurrence of said sensor feedback signal.

8. The apparatus of claim 6 wherein said comparator produces a gun ON transition commanding the fluid dispenser to open and dispense fluid onto the substrate, and said compensation signal represents a difference between an occurrence of said sensor feedback signal and said gun ON transition, said pattern control adjusting an occurrence of a subsequent gun ON transition to compensate for the switching time of the fluid dispensing gun.

9. The apparatus of claim 8 wherein said comparator is capable of producing a gun OFF transition commanding the fluid dispenser to close and cease dispensing fluid onto the substrate, said compensation signal representing a difference between an occurrence of said sensor feedback signal and said gun OFF transition, said pattern store adjusting an occurrence of a subsequent gun OFF transition to compensate for the switching time of the fluid dispensing gun.

10. An apparatus for operating a fluid dispensing gun to dispense fluid at a desired location onto a substrate moving relative to the dispensing gun, the dispensing gun being operated by a coil electromagnetically coupled to an armature and requiring a switching time to change operating states, the apparatus comprising:

a first sensor for detecting a feature of the substrate as it moves relative to the fluid dispensing gun prior to the fluid dispensing gun dispensing fluid onto the substrate;

a feedback device for detecting relative motion between the substrate and the fluid dispensing gun;

a counter connected to said first sensor end said feedback device for measuring the relative motion between the substrate and the dispensing gun in response to said first sensor detecting the feature of the substrate;

a pattern store for storing data relating to a series of fluid dispensing cycles;

a comparator connected to said counter and said pattern store and providing first signals to the gun driver causing the dispensing gun to execute the series of dispensing cycles;

a gun actuation sensor producing a sensor feedback signal representing a detected change of operating state of the fluid dispensing gun; and a switching time detector connected to said feedback device, said second sensor and said comparator and measuring the switching time, said switching time detector producing a compensation signal causing the comparator to adjust an application of the first signals to the gun driver, so that the dispensing gun dispenses fluid at the desired location on the substrate.

11. The apparatus of claim 10 wherein said gun actuation sensor comprises an accelerometer detecting motion of the armature.

* * * * *

UNITED STATES PATENT AND TRADEMARK OFFICE

CERTIFICATE OF CORRECTION

PATENT NO. : 6,849,130 B2
DATED : February 1, 2005
INVENTOR(S) : Peter W. Estelle It is certified that error appears in the above-identified patent and that said Letters Patent is hereby corrected as shown below:

Column 1,
Line 34, “0.008 inches” should read -- 0.008 inch --.
Line 37, “0.200 inches” should read -- 0.200 inch --.
Line 41, “reduces the quality” should read -- reduce the quality --.

Column 4,
Line 27, “is detected” should read -- are detected --.
Line 31, “herein” should read -- herein. --.

Column 7,
Line 55, “The, current” should read -- The current --.

Column 8,
Line 8, “Thus, the location” should read -- Thus, the locations --.
Line 59, “112a” should read -- 102a --.
Line 65, “measured delay 1101, 112a” should read -- measured delay 110b, 102b --.

Column 9,
Line 15, “110c, 112c” should read -- 110c, 102c --.

Column 14,
Line 9, “a counter connected to said first sensor end said feedback” should read -- a counter connected to said first sensor and said feedback --.

Signed and Sealed this

Twenty-third Day of August, 2005

JON W. DUDAS
*Director of the United States Patent and Trademark Office*